US011156437B2

(12) United States Patent
Welke

(10) Patent No.: US 11,156,437 B2
(45) Date of Patent: Oct. 26, 2021

(54) DEVICE FOR VENTING AIR FROM OR SUPPLYING AIR TO A ROOM

(71) Applicant: RHEINMETALL WAFFE MUNITION GMBH, Unterluess (DE)

(72) Inventor: Ingomar Welke, Celle (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 206 days.

(21) Appl. No.: 16/523,478

(22) Filed: Jul. 26, 2019

(65) Prior Publication Data

US 2019/0346238 A1 Nov. 14, 2019

Related U.S. Application Data

(63) Continuation of application No. PCT/EP2018/051362, filed on Jan. 19, 2018.

(30) Foreign Application Priority Data

Jan. 26, 2017 (DE) ..... 10 2017 101 478.0

(51) Int. Cl.
*F41H 7/03* (2006.01)

(52) U.S. Cl.
CPC ..... *F41H 7/035* (2013.01)

(58) Field of Classification Search
CPC ..... F41H 7/035; F41H 7/042
USPC ..... 109/49.5; 296/188, 187.03, 187.07
See application file for complete search history.

(56) References Cited

U.S. PATENT DOCUMENTS 3,428,141 A * 2/1969 Robert ..... F28D 9/0062 180/68.1
4,150,422 A * 4/1979 Peralta ..... F21V 15/04 362/218
4,179,979 A * 12/1979 Cook ..... F41H 5/0414 109/49.5
4,242,951 A * 1/1981 Bemiss ..... B60H 1/00414 454/146
4,325,283 A * 4/1982 Bemiss ..... F41H 7/035 180/68.6

(Continued)

FOREIGN PATENT DOCUMENTS

DE 1244021 B 7/1967
DE 2040285 A1 3/1972

(Continued)

OTHER PUBLICATIONS

International Search Report dated Mar. 20, 2018 in corresponding application PCT/EP2018/051362.

*Primary Examiner* — John Cooper
(74) *Attorney, Agent, or Firm* — Muncy, Geissler, Olds & Lowe, P.C.

(57) ABSTRACT

The invention relates to a device for venting or supplying air to a room, said room being delimited by walls. The room is completely surrounded by the walls and has a ventilation system for supplying an airflow in order to exchange the air in the room with the air outside of the room. For this purpose, the closed room is interrupted by an opening through which the airflow can enter or exit the room. The opening is then covered by at least three perforated plates, wherein the perforated plates are arranged in a layered manner relative to one another, and the perforated plates have two different degrees of hardness.

17 Claims, 1 Drawing Sheet

(56) References Cited

U.S. PATENT DOCUMENTS 5,014,593 A * 5/1991 Auyer ..... F41H 5/0457 109/84
5,394,786 A * 3/1995 Gettle ..... E04B 1/82 102/303
5,675,299 A * 10/1997 Suski ..... H05K 1/0224 333/1
5,682,124 A * 10/1997 Suski ..... H05K 1/0253 333/1
5,683,293 A * 11/1997 Mohammed ..... B60H 1/267 296/97.11
5,753,847 A * 5/1998 Middione ..... F41H 7/035 89/36.02
6,316,859 B1 * 11/2001 Aoyama ..... H02K 3/24 310/214
6,405,630 B1 * 6/2002 Gonzalez ..... F41H 7/035 89/36.01
7,191,694 B1 * 3/2007 Gonzalez ..... F41H 5/013 89/36.02
9,267,766 B2 2/2016 Serpeault et al.
9,429,395 B2 8/2016 Schade et al.
2011/0147631 A1 * 6/2011 Menassa ..... F24F 13/12 251/205
2011/0226122 A1 * 9/2011 Ciriscioli ..... F41H 5/0407 89/36.02
2012/0240757 A1 * 9/2012 Schade ..... F41H 5/026 89/36.02
2013/0160640 A1 * 6/2013 Livesey ..... F41H 5/023 89/36.02
2014/0251120 A1 9/2014 Schade et al.
2020/0316649 A1 * 10/2020 Partansky ..... B07B 9/02

FOREIGN PATENT DOCUMENTS

DE 2653056 A1 6/1978
FR 2990504 A1 11/2013
WO WO2014164531 A2 10/2014

* cited by examiner

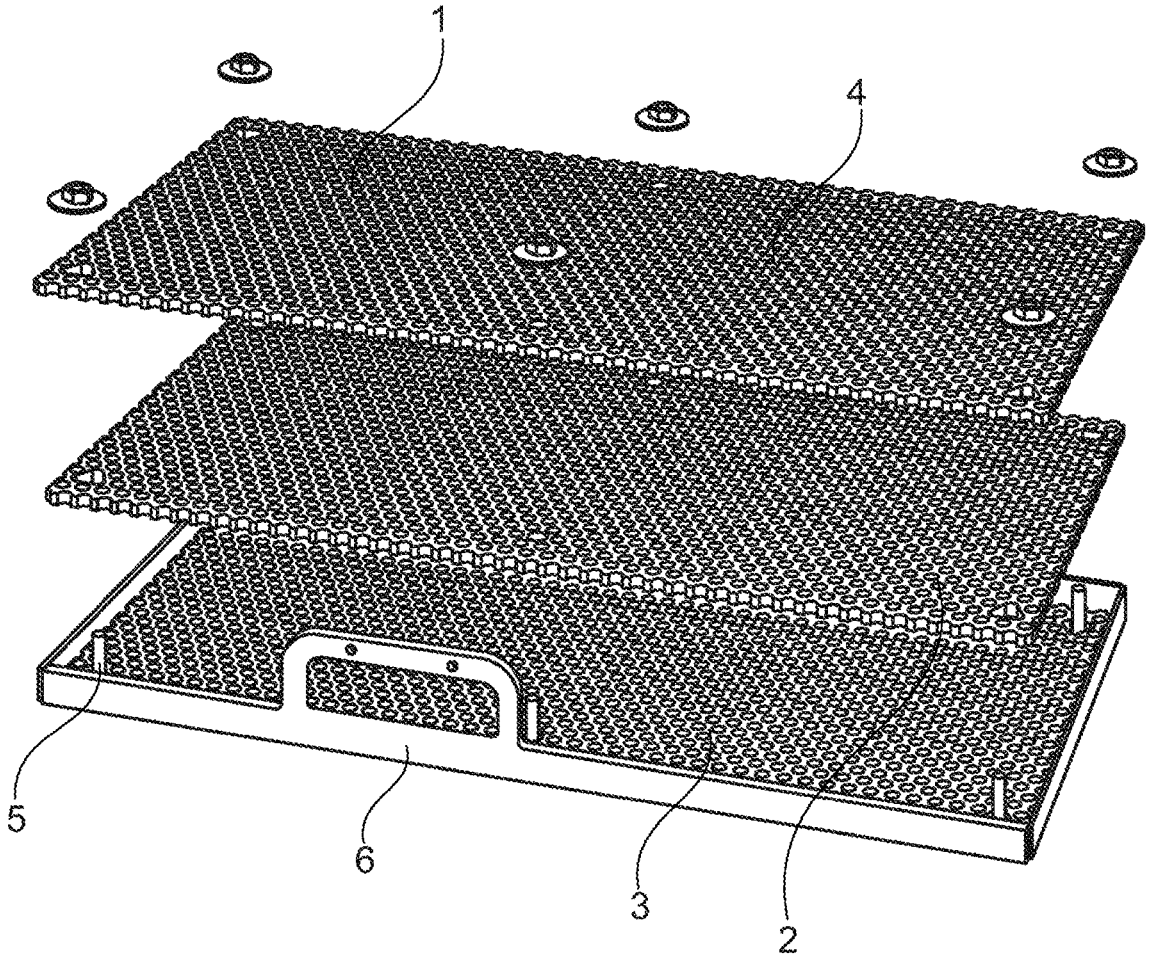
1
4
5
6
3
2

DEVICE FOR VENTING AIR FROM OR SUPPLYING AIR TO A ROOM

This nonprovisional application is a continuation of International Application No. PCT/EP2018/051362, which was filed on Jan. 19, 2018, and which claims priority to German Patent Application No. 10 2017 101 478.0, which was filed in Germany on Jan. 26, 2017, and which are both herein incorporated by reference.

BACKGROUND OF THE INVENTION

Field of the Invention

The present invention relates to a device for removing air from, or supplying air to, a space, wherein the space is surrounded by walls.

Description of the Background Art

Devices of this kind are required to supply air to, and remove air from, a space, when the space requires an exchange of air with the surrounding area. This is the case in vehicles, for example, in order to supply air to the interior of the vehicles and also to remove air from, and supply it to, an air-conditioning system. Other exemplary uses are supplying air to, and removing it from, fixed spaces such as houses or containers, for example.

The device according to the invention is intended to allow an air flow in order to supply air to, and remove air from, the space and therefore to offer up the lowest possible resistance to the supply and removal of air. For this purpose, an opening is required in at least one of the walls. The device then covers this opening while simultaneously facilitating the air flow. The device should be robust and stable in design, however, so that the passage of air is left unaffected wherever possible by external impacts.

A corresponding device is known from the prior art, for example from DE 20 40 285. This discloses a cooling system for armored vehicles, wherein a cooling air inlet is provided in the roof and covered by a grating. The grating has a correspondingly stable design, so that the passage of air is not adversely affected by external impacts, and is configured in such a manner that it is accessible.

A corresponding device is known from the prior art, for example from DE 20 40 285. This discloses a cooling system for armored vehicles, wherein a cooling air inlet is provided in the roof and covered by a grating. The grating has a correspondingly stable design, so that the passage of air is not adversely affected by external impacts and is configured in such a manner as to be accessible.

However, the relatively large openings in a grating mean that protection from external ballistic impacts, such as projectiles, for example, can only be achieved with some difficulty.

SUMMARY OF THE INVENTION

It is therefore an object of the present invention to provide a device for removing air from, and supplying air to, a space, wherein the device is configured in such a manner that the supply and removal of air is protected as effectively as possible against external impacts, including ballistic impacts, and nevertheless facilitates a high air flow.

This problem is solved by the features of the main claim, namely by a device for removing air from, or supplying air to, a space, wherein the space is surrounded by walls, having a ventilation system for generating an air flow and an opening in at least one of the walls at which the air flow begins or ends. According to the invention, the opening is covered by at least three perforated plates, wherein the perforated plates are arranged in layers relative to one another and exhibit two different hardnesses.

The space according to the invention which is to have air removed from it, or is to be supplied with air, is surrounded by walls and is therefore self-contained. In order to facilitate an exchange of air, an opening is provided in at least one of the walls, at which the air flow begins or ends. A ventilation system is likewise provided for generating an air flow.

In the simplest case, a ventilation system of this kind may be a pipe or hose which connects the interior to the opening in the space. Temperature differences in the interior of the space compared without the exterior of the space or also different air compositions, for example different oxygen concentration, mean that the air flow can then be facilitated. It passes from the interior of the space through the pipe or hose to the opening. The air flow direction in this case may be from the opening into the space or vice versa.

At least one fan or a similar flow machine is preferably provided which generates an air circulation and therefore controls or increases the air flow. An air-conditioning system may likewise be used as the ventilation system.

An air flow to the opening or away from the opening is created by the ventilation system and the closed space is thereby breached by the opening in place of the opening. In order to protect this breach, the opening is covered by at least three perforated plates according to the invention. The perforated plates are arranged alongside one another in layers and exhibit two different hardnesses. The cover is therefore configured in such a manner that the device is accessible when, for example, the opening is arranged in the roof of the space and is protected from ballistic impact. This protection from ballistic impacts is currently achieved in that, on the one hand, the perforated plates with the greater hardness ensure that ballistic impacts do not even enter the opening and the perforated plate with the lower hardness ensures that the energy impact is compensated for by the ballistic impact on the device. This is achieved by, among other things, the perforated plate with the lower hardness being deformed by this kind of impact and therefore absorbing the energy.

The at least three layers also ensure through their layered arrangement that splinters and other material fragments can be intercepted in the gaps or holes and are unable to get into the space.

The holes in the perforated plates may be configured as required. Hence, larger holes can be used in order to guarantee a greater air flow. However, the larger the holes, the lower the protection against external impacts offered by the device. Hence, for example, by varying the hole size or the hole overlap, depending on the requirements, there can be a variation between the greatest possible air flow and the greatest possible protection.

The perforated plates according to the invention comprise two different hardnesses, wherein the outwardly oriented perforated plate should advantageously have a high hardness. This serves to achieve the accessibility of the present device and ensures that the space has the greatest possible protection. The use of a material with a greater hardness ensures that the opening is reliably covered and the space is therefore for the most part completely delimited by the walls and the device.

The holes in the perforated plates preferably run perpendicularly, i.e. they run perpendicularly to the plane of the plate. This perpendicular hole pattern favors the shortest possible air flow path through the air plate and therefore the smallest possible resistance. However, the holes in the perforated plate may also be arranged obliquely to the plane of the perforated plate, in order to guarantee greater protection from external impacts. It is then also possible in this case for the bores in the different perforated plates to be provided in different oblique positions or for the oblique positions of the holes to oppose one another, so that a first perforated plate exhibits holes with a particular oblique position and the perforated plate following it, in other words the holes lying thereunder or thereabove, is at an opposing angle to the first perforated plate. These measures likewise favor protection from external impacts, in particular ballistic impacts, on the device.

The oblique arrangement of the holes means that it is also possible for the individual perforated plates to be thinner in design than in the case of holes running perpendicularly, since the path through the perforated plate is longer in the case of an obliquely arranged hole than through a perpendicularly arranged hole. The protective function of the perforated plate can therefore be guaranteed by the thickness and/or by the arrangement of the holes in the perforated plate.

The perforated plates with a greater hardness can be produced from reinforced steel. This has the advantage that when the device is introduced into an armored vehicle, the same material can be used as has already been used to armor the vehicle.

The perforated plate with the lower hardness can be produced from aluminum. The aluminum material favors deformation of the perforated plate or of the holes during impact on the perforated plate, so that energy can be absorbed and the space is therefore protected accordingly.

In order to simplify the assembly, in a preferred embodiment it is furthermore provided that the perforated plates are fitted in an installation frame. The installation frame with the perforated plates is then fitted into the opening. The perforated plates themselves can be layered by means of a receiver. For this purpose, it is preferably proposed that corresponding bores are provided in the corners of the perforated plates, in order to assemble the plates layered on top of one another by means of receiver. In the embodiment with the installation frame, the receiver can also be attached to the installation frame. In the simplest embodiment, the receiver comprise bolts. In order to secure the perforated plates, they can be clamped on the receiver by means of nuts, for example.

The holes in the perforated plates should be understood to be continuous recesses, wherein the shape of the holes is not initially specified. It is preferably proposed, however, that the perforated plates are designed with round holes, as these are can be easily realized as bores from a production point of view. It is also possible, however, for the holes to be polygonal in design. This can be achieved by punching the perforated plates, for example.

The perforated plates can be arranged parallel to one another, which guarantees uniform, continuous protection within the entire opening. However, the holes may also be arranged offset to one another or obliquely to one another. Depending on the protection required, if a very large opening is being used, for example, areas below the opening may require greater protection than others. Consequently, the plates may be arranged with different thicknesses relative to one another, so that the protection guaranteed for the opening by the plates is differently configured locally. Moreover, at least one plate may have a corrugated design on at least one surface. This design favors the fragment trap property.

The space with the device can be used in a vehicle, in particular an armored vehicle. However, it is likewise possible for the space to be installed in other objects requiring protection, for example buildings, containers or stationery armored units.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus, are not limitive of the present invention, and wherein the sole FIGURE illustrates a perspective layout of the device according to an exemplary embodiment of the invention.

DETAILED DESCRIPTION

The FIGURE shows the device according to an exemplary embodiment of the invention for removing air from, or supplying air to, a space, wherein the space itself is not shown. The device comprises three perforated plates 1, 2, 3 for this purpose which are arranged in a frame 6. The perforated plates 1, 2, 3 are oriented parallel to one another and are fitted in the frame 6 in layers. The receivers 5 are provided to assemble the perforated plates 1, 2, 3. These ensure that the perforated plates 1, 2, 3 are mounted fixedly to one another.

The perforated plates 1, 2, 3 have holes 4. In FIG. 1 the holes 4 are distributed regularly and uniformly on the perforated plates 1, 2, 3 and ensure an adequate air flow for the ventilation system which connects the space to the device.

The holes 4 may be arranged obliquely or, as in the present exemplary FIGURE, perpendicularly. The possible air flow can be controlled through this possible arrangement and also the overlapping of the holes 4 relative to one another. Likewise, this arrangement means that the protection which results for the opening on account of the device is influenced. The device protects the opening from external impacts, in particular ballistic impact.

In order to achieve this protective effect, the perforated plates are made of different hardnesses, wherein the perforated plates 1, 3 exhibit the greater hardness compared with the perforated plate 2.

This sandwich-like structure means that in case of ballistic impact, fragments are firstly trapped between and/or in the individual perforated plates 1, 2, 3 and cannot reach the ventilation system or the space. Secondly, the soft material of the perforated plate 2 ensures that fragments deform the soft material and energy can thereby be absorbed from the fragments before they are able to have an impact on the ventilation system or the space.

The installation frame 6 in which the perforated plates 1, 2, 3 are arranged is fitted in the opening by simple assembly means. This may involve screw-fastening, welding, soldering or latching.

The present invention is not limited to the aforementioned features, but further embodiments are also conceivable. Hence, the perforated plates may also adopt any other shape apart from a rectangle, for example a circle or oval. In this way, the device can be adapted to the corresponding opening being protected. Other materials are also likewise conceivable for the perforated plates, such as high-grade steel and plastic, for example. The only thing that is important in this case is that the plates with the greater hardness are suitable for resisting external impacts, which is why hard metals have proved effective. On the other hand, the plate with the lower hardness must be suitable for being able to absorb energy, for example by deformation. Aluminum, plastics, but also rubber or laminated paper, can be used for this purpose.

The invention being thus described, it will be obvious that the same may be varied in many ways. Such variations are not to be regarded as a departure from the spirit and scope of the invention, and all such modifications as would be obvious to one skilled in the art are to be included within the scope of the following claims:

What is claimed is:

1. A device for removing air from, or supplying air to, a space that is surrounded by walls, the device comprising:

a ventilation system for generating an air flow;

an opening in at least one of the walls at which the air flow begins or ends;

at least three perforated plates covering the opening, the at least three perforated plates being arranged in layers relative to one another, the at least three perforated plates having two different hardnesses and the at least three perforated plates each being rigidly fixed with respect to one another.

2. The device as claimed in claim 1, wherein two outer perforated plates of the at least three perforated plates exhibit a greater hardness by comparison with a perforated plate located between the two outer perforated plates.

3. The device as claimed in claim 2, wherein the two outer perforated plates are produced from reinforced steel.

4. The device as claimed in claim 2, wherein the perforated plate located between the two outer perforated plates is produced from aluminum.

5. The device as claimed in claim 1, wherein the at least three perforated plates have perpendicularly running holes.

6. The device as claimed in claim 1, wherein the at least three perforated plates have obliquely running holes.

7. The device as claimed in claim 1, wherein the at least three perforated plates are fitted in an installation frame that is insertable into the opening.

8. The device as claimed in claim 1, wherein the at least three perforated plates are arranged such that holes in the perforated plates are offset relative to one another.

9. The device as claimed in claim 1, wherein the at least three perforated plates are arranged such that holes in each of the at least three perforated plates are aligned in a same position.

10. The device as claimed in claim 9, wherein the holes in the at least three perforated plates are round.

11. The device as claimed in claim 9, wherein the holes in the at least three perforated plates are polygonal.

12. The device as claimed in claim 1, wherein the at least three perforated plates are arranged parallel to one another.

13. The device as claimed in claim 1, wherein the at least three perforated plates are arranged in layers via receivers.

14. The device as claimed in claim 13, wherein the receivers are pegs that are inserted into corresponding receiving holes of each of the at least three perforated plates to fixedly mount the at least three perforated plates to each other.

15. The device as claimed in claim 14, wherein the receivers are provided in an installation frame into which the at least three perforated plates are accommodated.

16. The device as claimed in claim 1, wherein the space is arranged in a vehicle.

17. The device as claimed in claim 1, wherein the device with the wall in which the opening is introduced runs in a plane.

* * * * *